US007163446B1

(12) United States Patent
Cole et al.

(10) Patent No.: US 7,163,446 B1
(45) Date of Patent: Jan. 16, 2007

(54) VEHICLE HEADLIGHT RESTORATION

(76) Inventors: John Ray Cole, P.O. Box 14493, Durham, NC (US) 27709; Ravonda Lynn Cole, P.O. Box 14493, Durham, NC (US) 27709

( * ) Notice: Subject to any disclaimer, the term of this patent is extended or adjusted under 35 U.S.C. 154(b) by 0 days.

(21) Appl. No.: 11/157,017

(22) Filed: Jun. 20, 2005

(51) Int. Cl.
*B24B 7/30* (2006.01)

(52) U.S. Cl. ..... 451/54; 451/41; 451/42; 451/57; 510/163

(58) Field of Classification Search ..... 451/54, 451/41, 42, 57, 921; 510/163, 243
See application file for complete search history.

(56) References Cited

U.S. PATENT DOCUMENTS

| | | | | |
|---|---|---|---|---|
| 3,659,307 | A | 5/1972 | Vitou | |
| 4,080,685 | A | 3/1978 | Vanderpool | |
| 4,661,182 | A * | 4/1987 | Lerner | 156/94 |
| 5,248,521 | A * | 9/1993 | Yamane et al. | 427/140 |
| 5,443,604 | A * | 8/1995 | Stowell | 51/307 |
| 5,569,346 | A | 10/1996 | Marshall | |
| 6,001,793 | A | 12/1999 | Figdore et al. | |
| 6,244,707 | B1 * | 6/2001 | Faubl | 351/160 H |
| 6,398,396 | B1 | 6/2002 | Nestell et al. | |
| 6,428,407 | B1 * | 8/2002 | Elder | 451/530 |
| 6,583,097 | B1 | 6/2003 | McDonald | |
| 6,638,563 | B1 | 10/2003 | McGee et al. | |
| 6,831,049 | B1 | 12/2004 | Torres Moreno | |
| 6,846,567 | B1 | 1/2005 | Ekinaka et al. | |
| 6,855,210 | B1 | 2/2005 | Dostic et al. | |
| 6,984,612 | B1 * | 1/2006 | Maillie | 510/163 |
| 7,045,001 | B1 * | 5/2006 | Kropp et al. | 106/3 |
| 2003/0211962 | A1 | 11/2003 | Held, III et al. | |
| 2004/0121927 | A1 | 6/2004 | McDonald | |
| 2004/0157758 | A1 | 8/2004 | Adickes | |
| 2004/0235699 | A1 | 11/2004 | Torres Moreno | |
| 2006/0024427 | A1 * | 2/2006 | Clyde et al. | 427/58 |

OTHER PUBLICATIONS

Clearstar Coatings Corp., collection of screen shots from Internet—10 pages total, date unknown.

(Continued)

*Primary Examiner*—Joseph J. Hail, III
*Assistant Examiner*—Robert Scruggs
(74) *Attorney, Agent, or Firm*—Miller Patent Services; Jerry A. Miller

(57) ABSTRACT

A method of restoring a discolored automobile headlight lens without removal of the lens from the automobile consistent with certain embodiments involves wet abrading an outer surface of the lens with successively finer grit wet sanding disks, using a low speed rotary or orbital tool having a flexible sanding holder holding the sanding disks, until a smooth surface is achieved exhibiting no discoloration, wherein the wet sanding disks comprise disks starting from approximately 220 to 400 grade down to approximately 2000 grade; polishing the outer surface of the lens with an aqueous paste abrasive polish containing aluminum oxide abrasive particles; cleaning any residue from the outer surface of the lens by wiping the lens with a lint free cloth; and spraying a film forming aqueous polymer dispersion containing an ultraviolet protectant to the outer surface of the lens, wherein the sealer comprises of acrylic urethane copolymers, Hindered Amine Light Stabilizers, benzotriazole UV light absorbers, 1-methyl-2-pyrrolidone, and dipropylene glycol monomethyl ether. This abstract is not to be considered limiting, since other embodiments may deviate from the features described in this abstract.

14 Claims, 2 Drawing Sheets

OTHER PUBLICATIONS

Material Safety Data Sheet for Brite Lites Lens Cleaner, two pages, date unknown.

"Brite Lites Plastic Lens Restorer", Five pages from Internet, date unknown.

Material Safety Data Sheet for Aqua-Buff 2000, two pages, May 19, 1993.

Material Safety Data Sheet for Clearstar High Performance Gloss Clear Protective Coating, two pages, Aug. 16, 2001.

"Headlight Restoration Kits", Detail King's Supply Online Mall, Three pages from Internet, GoEmerchant, 2003.

Crystal View Chemicals, Inc., "Directions for Headlight Restoration Kit", two pages from Internet, 2004.

Lens Renew, "New Life for Your Plastic Headlight Lenses", two pages from Internet, 2004.

Clearstar Coatings Corp., "Liquid Laminate Manual", 13 pages, 2004.

Rightlook Automotive Reconditioning Equipment & Training, Clearlights Headlight Restoration Kit, two pages from Internet, 2005.

* cited by examiner

VEHICLE HEADLIGHT RESTORATION

BACKGROUND

As automobiles age and are exposed to sunlight, chemicals, pollution, soil, pollen, dust and other contaminants, the lenses of the headlights commonly take on a yellowish translucent or opaque appearance. This yellowish discoloration can be a surface film, an actual discoloration of the plastic commonly used to make such lenses or a combination of both. This discoloration is not only unsightly and detracting from an automobile's value, but also reduces the effective brightness and focus of the headlamps.

One solution to this problem is replacement of the lens assembly. Unfortunately, replacement lens assemblies are costly. The labor involved to replace such lens assemblies can further escalate the price of replacement to surprisingly high levels. Whether one wishes to sell a vehicle with discolored headlights or retain it, it is obviously desirable to keep the cost of restoration of discolored lenses to a minimum.

U.S. Pat. No. 6,831,041 describes a cleaning pad specifically made to clean headlight lenses. Various commercial products are also available on the market which are designed to restore headlight lenses. However, each has been found to have undesirable characteristics. For example, some products provide no protection against further damage and discoloration by the factors listed above, and others have in fact been used with unsatisfactory results by the current inventor. Other products contain harsh solvents and other chemicals which may either be dangerous to use or can potentially damage an automobile's paint. Still others are complicated multiple part systems.

BRIEF DESCRIPTION OF THE DRAWINGS

Certain illustrative embodiments illustrating organization and method of operation, together with objects and advantages may be best understood by reference to the detailed description that follows taken in conjunction with the accompanying drawings in which.

DETAILED DESCRIPTION

Figure 1:
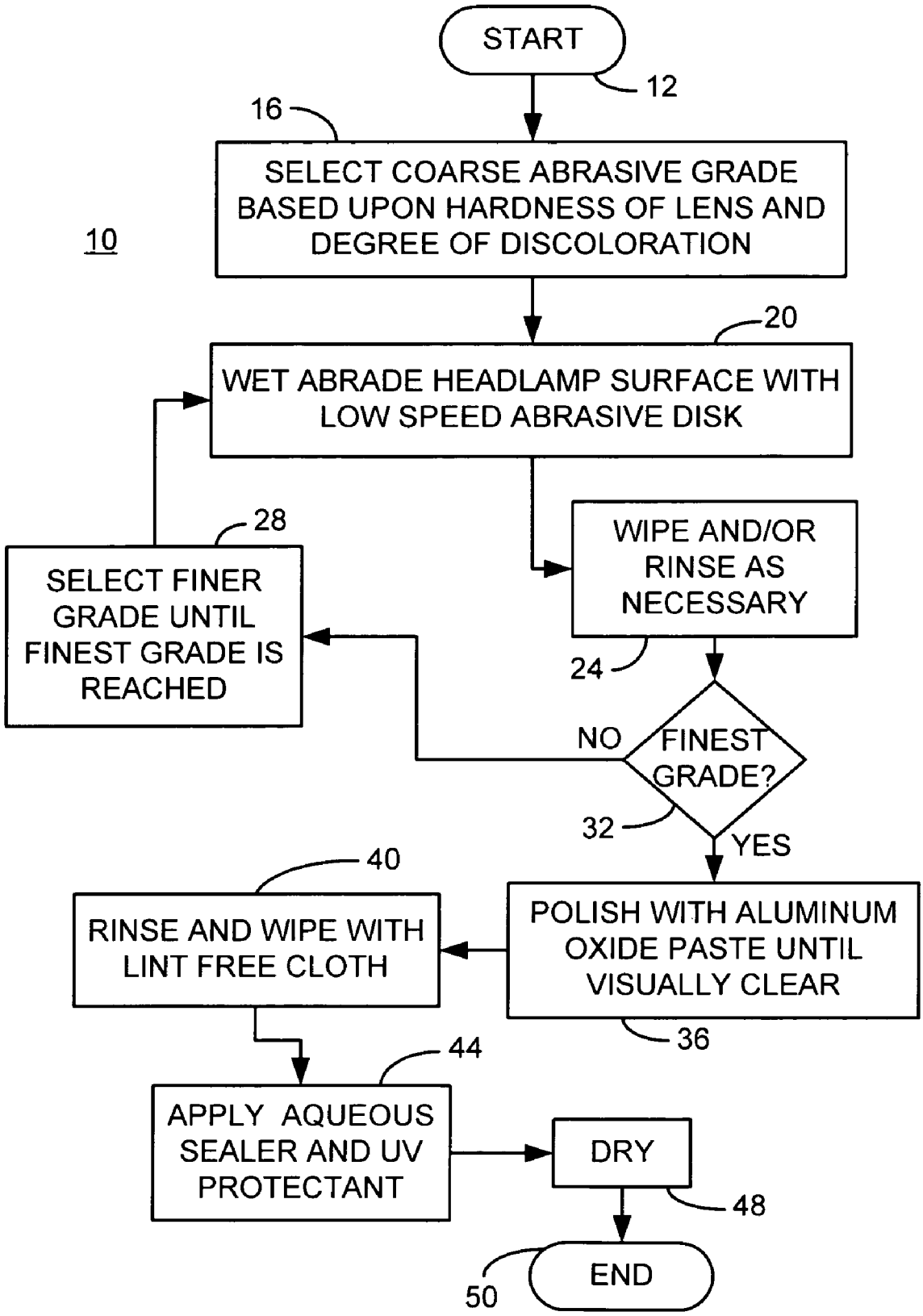
FIG. 1 is a flow chart of a method of headlight lens restoration consistent with certain embodiments of the present invention.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment". "certain embodiments", "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The terms "sandpaper" and "abrasive paper" and similar terms as used herein are intended to embrace coated or otherwise abrasive paper, cloth, fabric, mesh or other substrate materials without limitation. Moreover, other abrasive materials having similar properties can be readily substituted as equivalents without departing from the invention. Accordingly, such terms should also be considered to embrace such equivalents.

In view of the above background, it is desirable to provide a method for restoration of discolored (e.g., yellowed) automobile, or other vehicle, headlight assemblies which can be safely, and effectively used while the headlight lens assembly remains attached to the automobile or other vehicle. Such a method should preferably provide long lasting protection, while posing minimal danger to the user. Further, such a method should pose minimal danger to paint, chrome, rubber and other components of the automobile.

Turning now to FIG. 1, a process 10 consistent with certain embodiments of the present invention is depicted in flow chart form starting at 12. An abrasive process is initially used to remove the film or yellowed portion of the lens surface starting at 16. At 16, a relatively coarse grit abrasive paper such as wet/dry sandpaper approximately in the range of grade 220 to 400.

Sandpaper is graded using at least three different systems: Coated Abrasives manufacturer's Institute (CAMI), Federation of European Producers Association (FEPA), and Japanese Industrial Standard (JIS). For purposes of this document, the example sandpaper grades are expressed using CAMI grading, but similar or corresponding grades (grits) from any other system can be utilized.

At 16, the starting abrasive can be selected based upon a number of factors including hardness of the headlight lens (e.g., lenses in certain Ford™ automobiles have been observed to be noticeably harder than certain other lenses), the level of discoloration, and the aggressiveness of the tool being used. Generally, abrading can begin with a wet/dry sandpaper grade between about 220 and 400, and selection is based upon experience. One can generally safely start with 400 grade and determine if it appears to be cutting at an adequately aggressive pace. If not, the process can start over with a coarser grade such as 220 or 320.

In certain embodiments, the abrading process of 20 is carried out using wet sanding with water and wet/dry sandpaper. The abrading can be carried out with a wet/dry sanding disk (approximately 7.6 cm in diameter has been found suitable) mounted to a flexible backing (e.g., a dense but flexible foam rubber backing) and driven by a low speed (actual speed has not been measured, but is roughly estimated to be in the range of several hundred to perhaps as much as 1000 RPM) rotary device such as an electric or pneumatic powered drill or other rotary tool. The speed of the rotary tool is selected to balance between speed of removal of the discoloration and the amount of heat that the lens can tolerate without surface melting. Non-rotary tools such as orbital sanding devices (e.g., quarter sheet devices) may be equivalently used and function well, provided they are not so aggressive as to melt the lens in use. Use of random orbital sanding devices has been tried, and could possibly be effectively used, but the device tried was been found to be difficult to control. Some headlight lenses also are more readily abraded by use of hand sanding. The selection of tool versus hand sanding is made depending upon the shape and contour of the headlight lens. Often, some level of hand abrading is necessary to reach hard to sand areas.

Once the discoloration has been removed, or mostly removed by the coarse grade sanding, the lens can be cleaned by wiping or rinsing if necessary at 24 to remove the larger grit particles that may remain and hinder removing the scratches. Successively finer grade sanding is then carried out by selection of finer grade sandpapers at 28 and repeating the process. The objective of the succession of finer grade papers is to remove the large scratch marks from the surface of the lens until the lens appears to have a relatively smooth surface that is virtually free of visible individual scratches. This normally occurs at a sandpaper grade of approximately 2000, plus or minus a grade. A typical succession of grades might involve use of all common grades, or skipping every other available grade, or skipping two grades as the process proceeds. Commonly the following progression of paper grades can be used: start: 220→400→600→800→2000. Other progressions with more or fewer grades may be in order depending upon the condition of the headlight. With experience, decisions as to which grade is appropriate to the current condition of the lens will be easily made. When the finest grade is reached at 32 (normally about 2000 grade), a final wet abrasion is carried out and the lens is wiped clean and/or rinsed at 24.

At this point, the lens may still appear somewhat cloudy or foggy due to the microscopic scratches left behind from the fine grit abrasive operation, but the yellow discoloration should be eliminated. At this point, the lens is polished at 36 using a water based aluminum oxide paste polish which is diluted with water and applied either manually or with a polishing tool using a soft cloth or other material such as wool. In this operation, a water based polishing paste such as Aqua-Buff 2000 (available from The Matchless Metal Polish Company, 840 West 49$^{th}$ Place, Chicago, Ill. 60609 USA) has been found suitable. This material was developed for polishing the surface of boats and the like. This material comes as a dense paste (roughly the density of bread dough) and contains very fine abrasive particles of aluminum oxide. For the operation of 36, the paste is diluted with water to achieve a consistency approximately that of toothpaste. This is normally achieved by dilution with approximately equal parts of water, but this dilution is not critical.

Operation 36 continues until the lens appears visually clear to the naked eye. Additional water can be added to the lens surface during the polishing if the paste appears to be drying out. The paste residue is then washed off with water and dried with a lint free cloth at 40. A lint free cloth is used to help assure that no particles of lint are attracted to the lens during the drying process, since such particles would appear on the finished surface of the lens.

At 44 a film forming aqueous polymer dispersion containing an ultraviolet protectant is applied to the outer surface of the lens. The preferred product for this use is a sealer and ultraviolet light (UV) protectant based upon an aqueous acrylic urethane with additives that inhibit and/or absorb UV light; however, aqueous polyurethane products may possibly be substituted without departing from embodiments consistent with the present invention.

One product that has been found to be suitable for use as the sealer and UV protectant is commercially available from Clearstar Coatings Corporation (P.O. Box 390, Isle of Palms, SC 29451 USA) and is commercially marketed as ClearShield® Original formulation gloss liquid laminate. When used in this application, the product is diluted by adding approximately 50% (e.g., about 40% to 60%) of its volume of water and mixing well (i.e., 100 ml. of sealer is added to 50 ml. of water to produce a total of 150 ml.). This product was developed as a liquid laminate product for use in sealing the surface of signs, banners, digital inkjet output, printed or airbrushed products, art, and other graphic arts products. It is noted that the above-mentioned level of dilution is significantly greater than that recommended by the manufacturer, but has been found to work well.

The portion of ClearShield® Original formulation gloss liquid laminate which represents solids is not available from the manufacturer, but an experiment was conducted to attempt to determine this attribute. A protective coating was applied to at 2.0" by 2.0" (2.54 cm by 2.54 cm) sample of Lexan™ plastic in the same manner used for coating headlight lenses. The starting weight of the plastic was 7.77 grams. Immediately after application (while wet) the weight increased to 8.38 grams, indicating that approximately 0.61 grams of liquid was applied. After the sample was completely dry, it was weighed again and weighed 7.94 grams indicating that the dry weight of the coating was 0.17 grains which represents approximately 28% by weight of the diluted dispersion.

ClearShield® Original formulation gloss liquid laminate is a product which is based upon acrylic urethane copolymers. The product further contains Hindered Amine Light Stabilizers and benzotriazole UV light absorbers. Additionally, 1-methyl-2-pyrrolidone is used to improve adhesion and dipropylene glycol monomethyl ether is used as a co-solvent to help the resin coalesce and form a film. This product appears milky, but dries clear. This product has been found especially suitable because it is safe to use with minimal protective equipment, does not damage painted surfaces, rubber or other common automobile materials, and can be readily cleaned up.

While the invention should not be constrained by the theoretical explanation of operation of the various components of the preferred protective coating, it is nonetheless believed to be useful to speculate on the various properties of the components of the protective coating as follows.

In ClearShield® Original formulation gloss liquid laminate, it is likely that the vast majority of the dried film is the acrylic urethane copolymer. It is likely that the acrylic urethane copolymer represents greater than 90% of the weight of the dried film, but this has not been verified experimentally. The acrylic urethane copolymer matrix holds the UV protection in the film. The immediate appearance change caused by application of the acrylic urethane copolymer is a loss of fogginess. The dried acrylic urethane copolymer has a refractive index near to that of the plastic that is being refinished (at least much closer than the refractive index of air is). If the bulk of the plastic of the headlight lens is fairly clear, much of the fogginess is likely based on the surface of the headlight not being smooth on a microscopic scale. The many microscopic grooves, scratches and pits act as a collection of lenses, each aiming the light in a different direction.

Since light traveling between two clear materials with the same refractive index is not diffracted, a coating with a material of the same refractive index is optically equivalent to the coating being identical to the underlying material. The clearing action of the film is likely, at least in large part, due to the film smoothing out the surface of the headlight. It is believed likely that any film with a similar refractive index would have a similar short term effect. Other polymer films (e.g., polyurethane) would likely have a similar effect, but this analysis should not be considered limiting.

Most UV damage to the plastics is caused by UV light causing highly reactive, short lived chemicals (radicals) to be formed. There are two widely used classes of additives to protect polymers from UV degradation. ClearShield® Original formulation gloss liquid laminate has both.

The easier type of protection to explain is that by UV absorbers. UV which is absorbed is not available to form the highly reactive, short lived chemicals which harm the polymer. The absorbance of the UV generally follows Beer's law. Beer law states that the quantity of UV absorbed by the coating is proportional to the concentration in the coating times the thickness of the coating. This means that the UV absorbing protectants protect the more interior plastic more than the more superficial plastic. Since the additive concentration is never infinity, the protection of the plastic by this sort of additive is essentially minimal at the surface of the polymer which the UV enters. Since this "sun screen" type of protection involves no special intermolecular chemistry, any compound that strongly absorbs the damaging UV wavelengths will do. Therefore, there is great chemical diversity among the UV absorbing additives which are commonly used. Within that there are various benzotriazole absorbers. The general structure is:

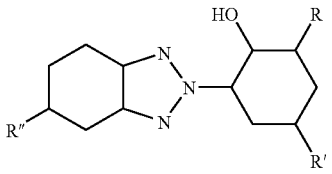

Hindered amine light stabilizers (HALS) act as radical scavengers. The HALS do not prevent the UV from causing the highly reactive, short lived chemicals to be formed. However, the HALS "defuse" the radicals so that they do not damage the plastic. The general structure for HALS is:

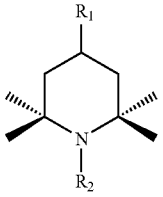

ClearShield® Original formulation gloss liquid laminate is also known to contain two solvents. 1-methyl-2-pyrrolidone (a.k.a. NMP) (shown below) is used widely in paint strippers and strippers to remove resins. NMP helps less polar compounds and water cohabitate a solution or dispersion. Dipropylene glycol monomethyl ether also helps less polar compounds and water cohabitate a solution or dispersion.

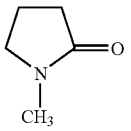

Many techniques might prove suitable for application of the sealer and protectant. The most suitable technique identified to date has been use of a small (e.g., 2 ounce bottle) pump fine mist atomizer bottle (widely available commercially at various retail outlets). The small size makes it easy to use and control for painting the surface of an automobile headlight at close proximity. Additionally, these bottles with attached atomizer are inexpensive and appear to work well without significant clogging.

The fine mist is simply painted on from top to bottom using short side to side strokes to form a continuous film of liquid over the lens surface. When dilute ClearShield® Original formulation liquid laminate is used, it is preferable that it be applied above 50° F. in an environment that is shielded from or free of wind (to minimize overspray) and direct sunlight. At higher temperature and lower humidity, a retarder such as ClearShield® RETARDER can be added to slow drying time. Somewhat low relative humidity is also beneficial to facilitate drying. The film is permitted to dry and cure at 48 for roughly 15 minutes at which point it is usually dry to touch. Multiple coats, while not normally required, can be used if needed or desired. Drying time is somewhat variable, however, and additional curing can be expected to take place over a period of days. The process is completed at 50, at which point the headlight appears crystal clear. The surface is protected from further yellowing by the protective coating which is durable and long-lasting. The thickness of the protective coating varies according to application conditions.

Thus, in accordance with certain embodiments, a method of restoring a discolored headlight lens without removal of the lens from the vehicle involves wet abrading an outer surface of the lens with successively finer grit abrasives until a smooth surface is achieved exhibiting no visible discoloration; polishing the outer surface of the lens with an aqueous paste abrasive polish; cleaning any residue from the outer surface of the lens; and applying a sealer comprising a film forming aqueous polymer dispersion containing an ultraviolet protectant to the outer surface of the lens, wherein the wet abrading, the polishing, the cleaning and the applying are carried out while the headlight lens remains attached to the vehicle.

Another method, consistent with certain embodiments, of restoring a discolored vehicle headlight lens without removal of the lens from the vehicle involves wet abrading an outer surface of the lens with successively finer grit wet sanding disks, using a low speed rotary tool having a flexible sanding holder holding the sanding disks, until a smooth surface is achieved exhibiting no visible discoloration; polishing the outer surface of the lens with an aqueous paste abrasive polish containing aluminum oxide abrasive particles; cleaning any residue from the outer surface of the lens; and applying a sealer comprising a film forming aqueous polymer dispersion containing an ultraviolet protectant to the outer surface of the lens, wherein the wet abrading, the polishing, the cleaning and the applying are carried out while the headlight lens remains attached to the vehicle.

Yet another method, consistent with certain embodiments, of restoring a discolored automobile headlight lens without removal of the lens from the automobile involves wet abrading an outer surface of the lens with successively finer grit wet sanding disks, using a low speed rotary or orbital tool having a flexible sanding holder holding the sanding disks, until a smooth surface is achieved exhibiting no discoloration, wherein the wet sanding disks comprise disks starting from approximately 220 to 400 grit down to approximately 2000 grit; polishing the outer surface of the lens with an aqueous paste abrasive polish containing aluminum oxide abrasive particles; cleaning any residue from the outer surface of the lens by wiping the lens with a lint free cloth; and spraying a film forming aqueous polymer dispersion containing an ultraviolet protectant to the outer surface of the lens, wherein the dispersion comprising acrylic urethane copolymers, a Hindered Amine Light Stabilizer, a benzotriazole UV light absorbers, 1-methyl-2-pyrrolidone, and dipropylene glycol monomethyl ether, wherein the wet abrading, the polishing, the cleaning and the applying are carried out while the headlight lens remains attached to the vehicle.

Figure 2:
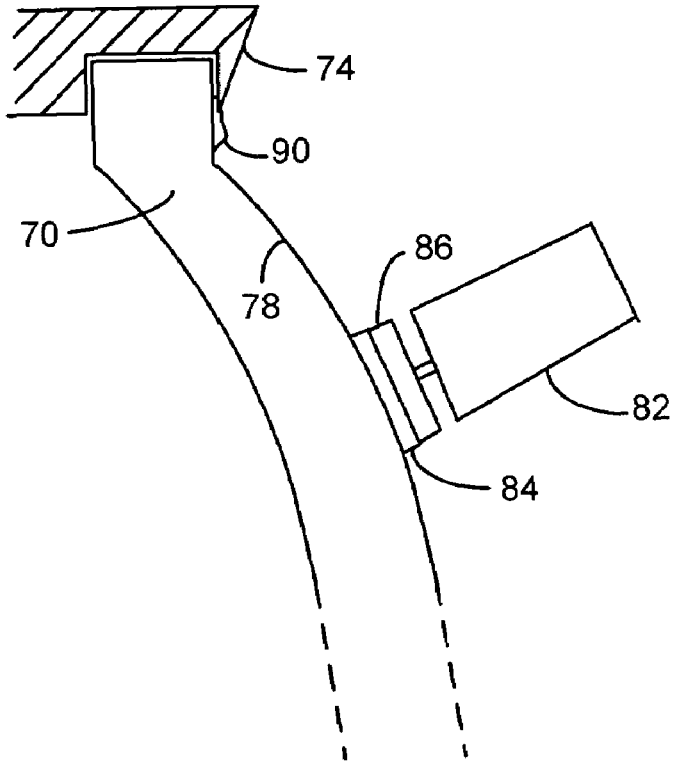
FIG. 2 illustrates an abrasive cleaning process consistent with certain embodiments of the present invention.

FIG. 2 illustrates the abrasive operation of 20 shown in disproportion for clarity. The headlight lens 70 is often held in place by a rubber gasket and frame assembly represented by 74 as well as possibly other supporting structures (not shown). The outer surface containing the discoloration is represented by 78. A rotary tool such as a drill 82 drives the sanding disk 84, which is attached to a flexible disk 86 using, for example, hook and loop fasteners.

During the abrasive operation, an accumulation of particles 90 can agglomerate and can become trapped at the edge of the rubber gasket or other support structure. This residue of particles 90 should be cleaned by rinsing with water and perhaps wiping with a cloth before beginning the polishing operation.

Figure 3:
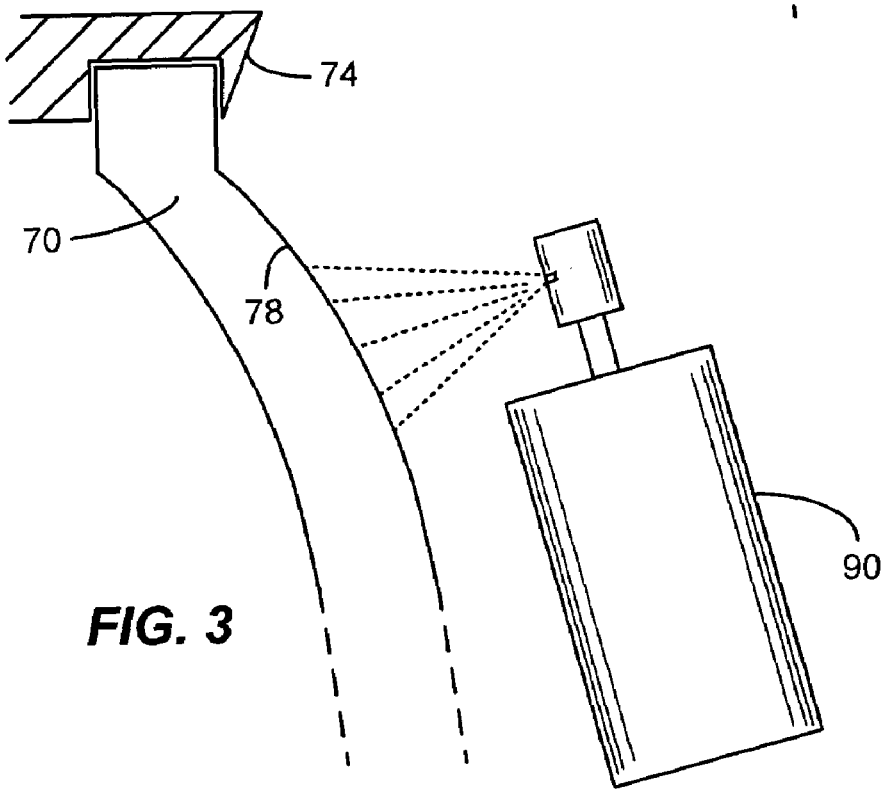
FIG. 3 illustrates a sealant application process consistent with certain embodiments of the present invention.

FIG. 3 illustrates the sealing process. A pump action sprayer 90 (similar in operation to that commonly used for window cleaner) which produces a fine mist is used to apply the sealer using a side to side motion to "paint" the surface from top to bottom until the surface is completely covered with a film of the sealer solution. Overspray and drips can normally be wiped from surrounding surfaces with a cloth if done immediately after spraying. If such overspray or drips go unnoticed and are permitted to partially dry, they can still be removed by aggressive use of a clean cloth. In either event, however, since the sealer is in an aqueous solution free of strong solvents, it has been found to not damage the paint or other automobile surfaces. This permits the user to confidently and safely restore the headlight without the labor involved in removal of the headlight from the automobile. The process can commonly be completed in approximately thirty minutes per lens on average.

A headlight lens refinished according to the present process produces a clear headlight lens that is generally visually indistinguishable from a new headlight. Tests have indicated that the longevity of the coating is far superior to that of certain commercially available products which failed within weeks.

The products needed to carry out the present operation can be supplied in kit form containing a selection of wet/dry sandpaper ranging in grade from 220 to 5000, a supply of aqueous aluminum oxide paste, an application pad for the aluminum oxide paste, a lint free cloth and a supply of film forming aqueous polymer solution containing an ultraviolet protectant. An application spray bottle for the sealer can also be provided.

While certain illustrative embodiments have been described, it is evident that many alternatives, modifications, permutations and variations will become apparent to those skilled in the art in light of the foregoing description.

What is claimed is:

1. A method of restoring a discolored vehicle headlight lens without removal of the lens from the vehicle, comprising in combination the ordered steps of:

(a) wet abrading an outer surface of the lens with successively finer grit abrasives until a smooth surface is achieved exhibiting no visible discoloration remaining;

(b) polishing the outer surface of the lens with an aqueous paste abrasive polish;

(c) cleaning any residue from the outer surface of the lens; and (d) applying a sealer comprising a film forming aqueous polymer dispersion containing an ultraviolet protectant to the outer surface of the lens, wherein the wet abrading, the polishing, the cleaning and the applying are carried out while the headlight lens remains attached to the vehicle, wherein the sealer comprises an aqueous dispersion containing acrylic urethane copolymers, a hindered amine UV protectant, a benzotriazole UV protectant, 1-methyl-2-pyrrolidone and dipropylene glycol monomethyl ether.

2. The method according to claim 1, wherein the wet abrading is carried out using a rotary or orbital drive tool to drive a sanding pad.

3. The method according to claim 1, wherein the applying comprises spraying the sealer onto the outer surface of the lens.

4. The method according to claim 1, wherein the cleaning is carried out by wiping the lens with a lint free cloth.

5. The method according to claim 1, wherein the aqueous paste abrasive polish comprises an aluminum oxide paste polish.

6. A vehicle headlight that has been restored according to the method of claim 1.

7. The method according to claim 1, wherein the film forming aqueous polymer dispersion consists essentially of ClearShield® Original brand formulation of gloss liquid laminate containing acrylic urethane copolymers, a Hindered Amine Light Stabilizer, a benzotriazole UV light absorber, 1-methyl-2-pyrrolidone, and dipropylene glycol monomethyl ether diluted with a volume of water representing approximately 50% of the volume of the liquid laminate.

8. A method of restoring a discolored vehicle headlight lens without removal of the lens from the vehicle, comprising in combination the ordered steps of:

(a) wet abrading an outer surface of the lens with successively finer grit wet sanding disks, using a low speed rotary tool having a flexible sanding holder holding the sanding disks, until a smooth surface is achieved exhibiting no visible discoloration remaining;

(b) polishing the outer surface of the lens with an aqueous paste abrasive polish containing aluminum oxide abrasive particles;

(c) cleaning any residue from the outer surface of the lens, and (d) applying a sealer comprising a film forming aqueous polymer dispersion containing an ultraviolet protectant to the outer surface of the lens, wherein the wet abrading, the polishing, the cleaning and the applying are carried out while the headlight lens remains attached to the vehicle, wherein the sealer comprises an aqueous dispersion containing acrylic urethane copolymers, a hindered amine UV protectant, a benzotriazole UV protectant, 1-methyl-2-pyrrolidone and dipropylene glycol monomethyl ether.

9. The method according to claim 8, wherein the applying comprises spraying the sealer onto the outer surface of the lens.

10. A vehicle headlight that has been restored according to the method of claim 8.

11. The method according to claim 8, wherein the film forming aqueous polymer dispersion consists essentially of ClearShield® Original brand formulation of gloss liquid laminate containing acrylic urethane copolymers, a Hindered Amine Light Stabilizer, a benzotriazole UV light absorber, 1-methyl-2-pyrrolidone, and dipropylene glycol monomethyl ether diluted with a volume of water representing approximately 50% of the volume of the liquid laminate.

12. A method of restoring a discolored automobile headlight lens without removal of the lens from the automobile, comprising in combination the ordered steps of:

(a) wet abrading an outer surface of the lens with successively finer grit wet sanding disks, using a low speed rotary or orbital tool having a flexible sanding holder holding the sanding disks, until a smooth surface is achieved exhibiting no discoloration, wherein the wet sanding disks comprise disks starting from approximately 220 to 400 grit down to approximately 2000 grit;

(b) polishing the outer surface of the lens with an aqueous paste abrasive polish containing aluminum oxide abrasive particles;

(c) cleaning any residue from the outer surface of the lens by wiping the lens with a lint free cloth; and (d) spraying a film forming aqueous polymer dispersion containing an ultraviolet protectant to the outer surface of the lens, wherein the dispersion comprising acrylic urethane copolymers, a Hindered Amine Light Stabilizer, a benzotriazole UV light absorber, 1-methyl-2-pyrrolidone, and dipropylene glycol monomethyl ether, wherein the wet abrading, the polishing, the cleaning and the applying are carried out while the headlight lens remains attached to the vehicle.

13. The method according to claim 12, wherein the film forming aqueous polymer dispersion consists essentially of ClearShield® Original brand formulation of gloss liquid laminate containing acrylic urethane copolymers, a Hindered Amine Light Stabilizer, a benzotriazole UV light absorber, 1-methyl-2-pyrrolidone, and dipropylene glycol monomethyl ether diluted with a volume of water representing approximately 50% of the volume of the liquid laminate.

14. A vehicle headlight that has been restored according to the method of claim 12.

* * * * *